United States Patent [19]

Briggs

[11] 3,936,280

[45] Feb. 3, 1976

[54] TREATMENT AND APPARATUS FOR SEPARATION OF COMBUSTION BY-PRODUCTS FROM AN INTERNAL COMBUSTION ENGINE

[76] Inventor: George L. Briggs, Frazier Pasture Road, Box 864, Ogunquit, Maine 03907

[22] Filed: Nov. 9, 1973

[21] Appl. No.: 414,243

[52] U.S. Cl. ..... 55/3; 55/100; 55/139; 55/150; 55/154; 55/DIG. 30; 60/275

[51] Int. Cl.[2] ..... B03C 1/00

[58] Field of Search ..... 55/3, 100, 129, 138, 139, 55/150, 154, DIG. 30; 23/277 C; 210/222, 223; 60/275

[56] References Cited

UNITED STATES PATENTS

| | | | |
|---|---|---|---|
| 2,637,408 | 5/1953 | Yadoff | 55/100 |
| 3,157,479 | 11/1964 | Boles | 55/DIG. 30 |
| 3,277,631 | 10/1966 | Sunnen | 55/100 |
| 3,526,081 | 9/1970 | Kusters | 23/277 C |
| 3,762,135 | 10/1973 | Ikebe et al. | 55/100 |

FOREIGN PATENTS OR APPLICATIONS

| | | | |
|---|---|---|---|
| 554,303 | 3/1958 | Canada | 55/100 |

*Primary Examiner*—Bernard Nozick
*Attorney, Agent, or Firm*—Eyre, Mann & Lucas

[57] ABSTRACT

The combustion by-products in the effluvium of an internal combustion engine are treated in a magnetic field to remove electrons from the atoms of the combustion by-products which may thereafter be removed from the effluvium preferably by means carried within the confines of a second magnetic field. In the preferred embodiment, the combustion by-products are mixed to enhance commingling of the by-products of combustion prior to treatment in the magnetic field.

7 Claims, 7 Drawing Figures

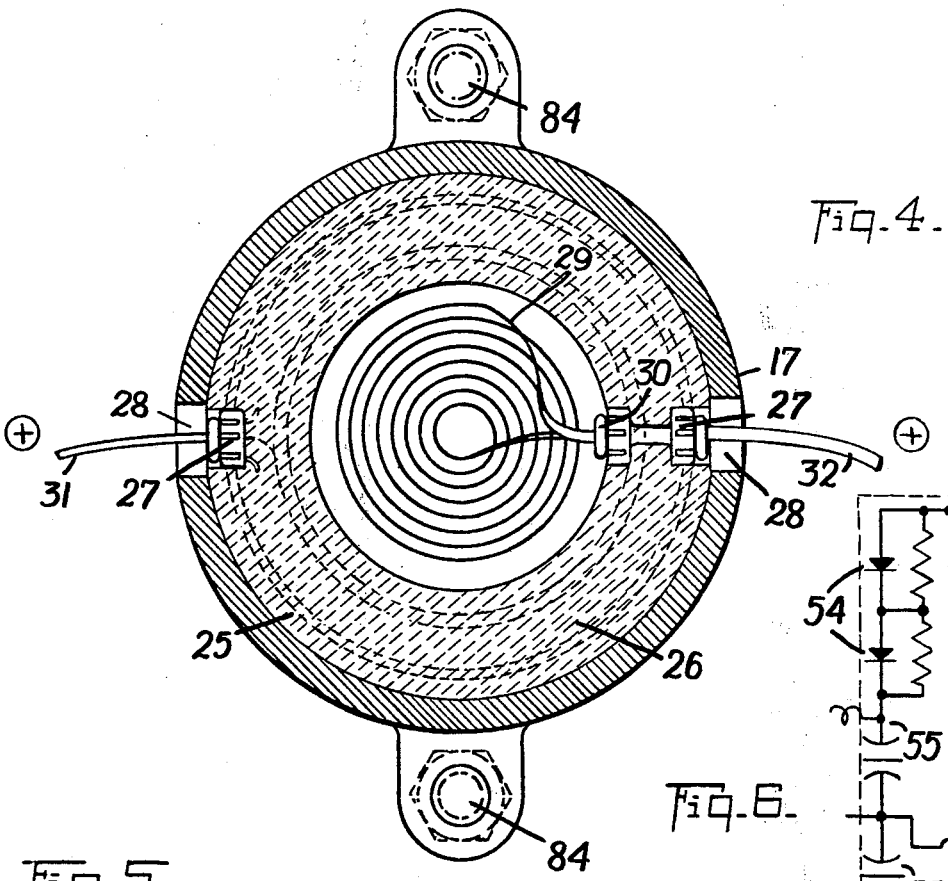
Fig. 4.
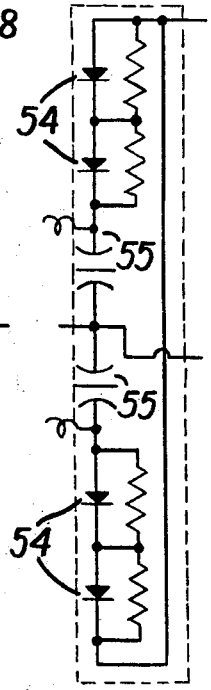
Fig. 6.
Fig. 5.
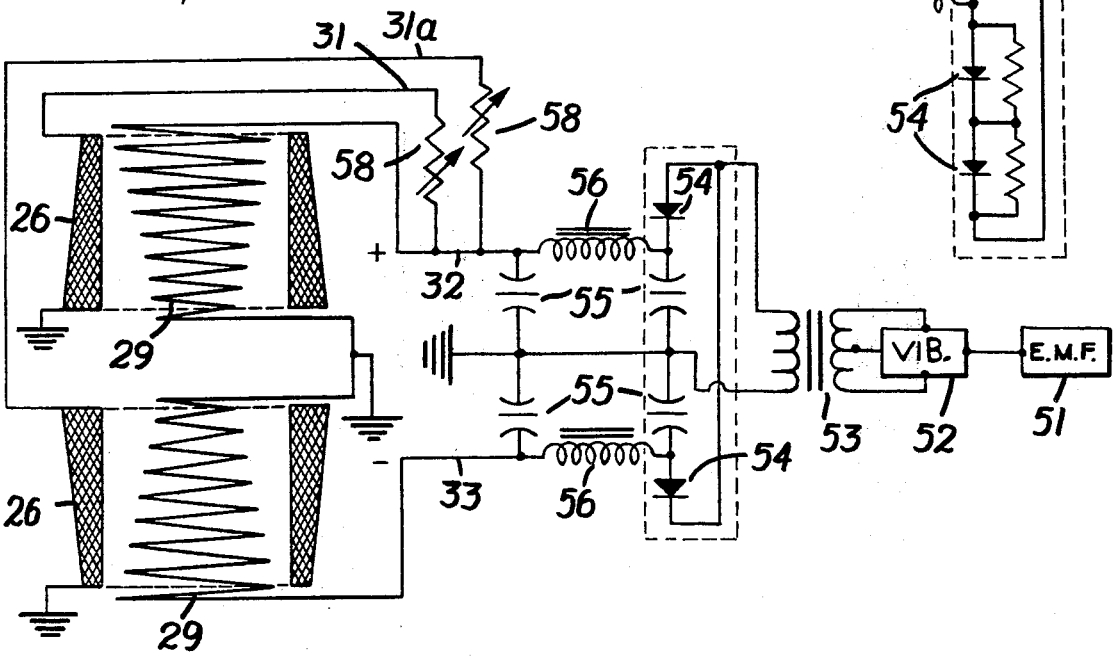

TREATMENT AND APPARATUS FOR SEPARATION OF COMBUSTION BY-PRODUCTS FROM AN INTERNAL COMBUSTION ENGINE

This invention relates to the control and elimination of the by-products of combustion in the exhaust of internal combustion engines, in particular those of the heptane-air burning type, such as automobile engines.

While many attempts have been made in the art to achieve the above mentioned desirous results, until the present, the means employed and resultant effects therefrom have not only been extremely expensive to the consuming public but inefficient in eliminating the hazardous conditions which effect all living things in the environment where such energy producing units are used.

One object of this invention is to provide a method and means for the commingling of the various by-products of combustion adjacent the efflux orifice of the exhaust manifold, thus prolonging the propagation of flame within the commingled effluvium.

Another object of the invention is the arrangement of coacting means, which allows for said commingling, in such a manner as to provide each succeeding efflux area to be slightly larger than the preceding efflux area, whereby the normal back pressure within the exhaust manifold is not increased.

A further object is to provide means for stripping of the atoms of the issuing effluvium of their respective electrons and capturing same as current flow and thence to ground.

A still further object is to provide means for the capture of the ionized nuclei of said atoms as electrical entities of current flow and thence to ground.

A still further object is to achieve these and other advantageous results in an inexpensive and efficient manner, the means being employed are neither difficult of manufacture or assembly, simple to apply and without the deleterious effect upon the engine, such as heretofore practiced in the art.

The invention accordingly consists in the features of construction, combination of elements, arrangement of parts and in the several steps and relation and order of each of the same to one or more of the others thereof, all as will be illustratively described herein, and the scope of the application of which will be indicated in the following claims.

In the accompanying drawings, in which are illustratively shown the mechanical and electrical features of a preferred embodiment of my invention and in which similar reference characters refer to similar parts throughout the several views.

FIG. 4 is a sectional view, enlarged, looking in the direction of 4—4 of FIG. 1, showing the arrangement of various components, the vertical axis of said sectional view also being coincidental with the efflux orifice.

FIG. 5 is a schematic outline of the circuitry applied to the device to achieve the results as claimed.

FIG. 6 is a partial circuit arrangement which may be substituted in FIG. 5, within the perimeter of the dot and dash outline in FIG. 5, whereby higher voltages may be accommodated in said circuit.

Figure 1:
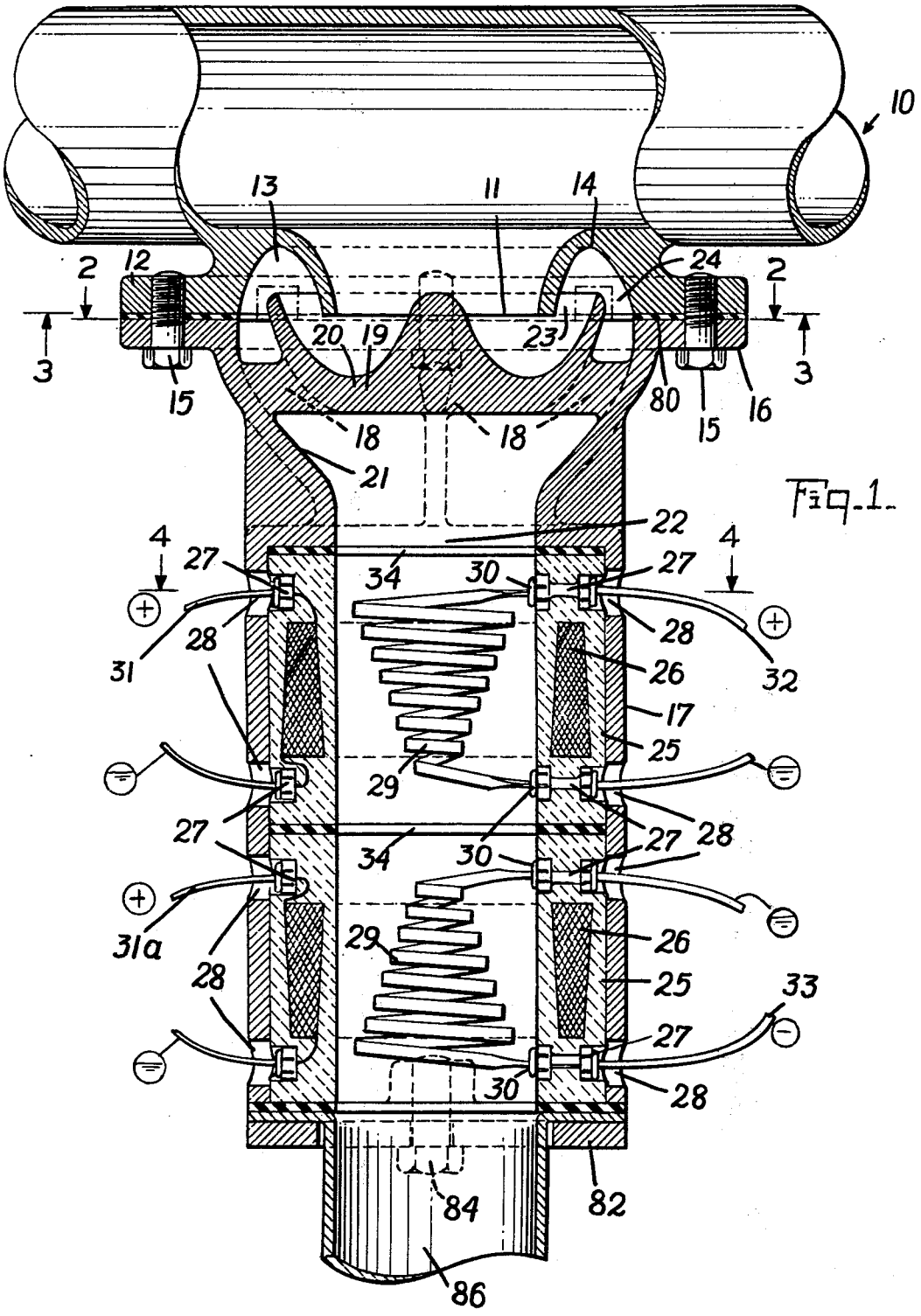
FIG. 1 is a vertical view, partly in section and partly broken away, showing the arrangement of an efflux orifice of an exhaust manifold, and its co-acting elements affixed thereto.
Figure 2:
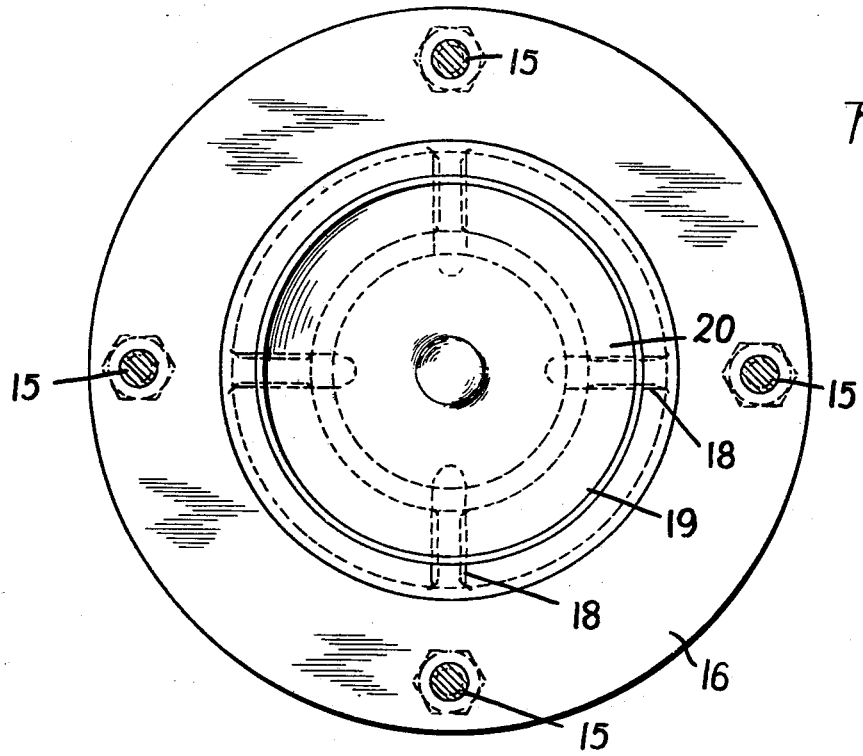
FIG. 2 is a view looking in the direction of 2—2 of FIG. 1 showing the intercepting semi-toroid, the vertical axis of which is arranged coincidental with the vertical axis of the efflux orifice of the manifold.
Figure 3:
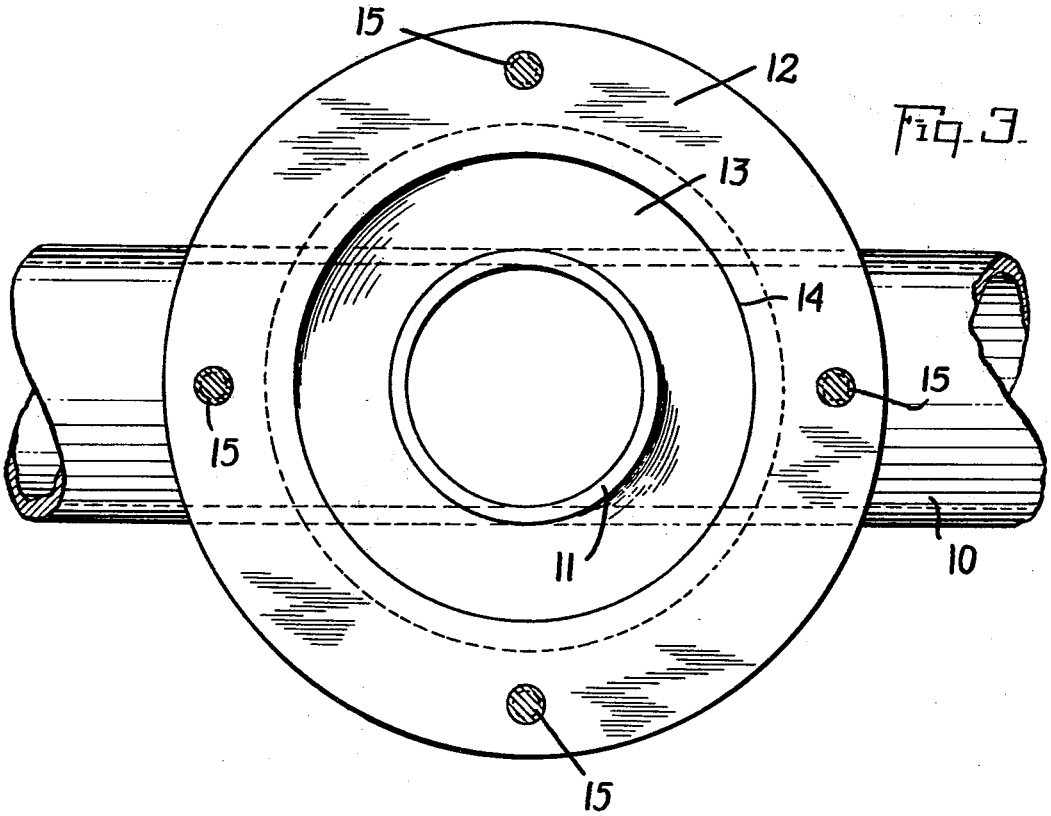
FIG. 3 is a view, partly broken away, looking in the direction of 3—3, of FIG. 1, showing the reversing semi-toroid, the vertical axis of which is coincidental with the vertical axis of the efflux orifice of the manifold.

Referring to the drawings of a preferred embodiment of the invention, FIG. 1 shows an exhaust manifold 10, provided with an efflux orifice 11, intermediate the ends thereof, it to be fully understood that said efflux orifice and its co-acting elements could advantageously be formed at the end of said manifold in a like manner. The efflux orifice 11 is formed integral with said manifold 10, in such a manner as to provide an annular flange 12, having formed within the body of flange 12 a semi-toroid 13, having a parabolic surface of revolution 14 adjacent to and coaxial with said efflux orifice 11.

Affixed to said flange 12, by bolts 15, is an annular flange 16, having depending therefrom and formed integral therewith a cylindrical body portion or housing 17, the longitudinal axis of which is coincidental with the axis of the efflux orifice 11. Carried within and formed integral with body portion 17, adjacent the upper end thereof by ribs 18, there is found an intercepting semi-toroid 19, having a parabolic surface of revolution 20, the axis of which is coincidental with the axis of semi-toroid 13, with which it is arranged to co-act in a manner hereinafter described. Below semi-toroid 19, the internal cylindrical body surface 21 is formed inwardly to a diameter which provides a diametrical neck area 22, which is at least equal to the diametrical area of the efflux orifice 11.

The function of the co-acting opposed surfaces of semi-toroids 13, 19, will now be described. As the exhaust issues from the efflux orifice 11, carrying the by-products of combustion and attendant gases, it is intercepted by semi-toroid 19, which reverses the flow from its initial direction out through the annular efflux area 23, which lies intermediate the inner cusp of the reversing semi-toroid 13, and the outer cusp of the intercepting semi-toroid 19, whereupon the flowing effluvium encounters the semi-toroid 13, which reverses the reversed flow in the direction of the initial flow direction out through the annular efflux area 23, intermediate the outer cusp of the intercepting semi-toroid 19, and the outer cusp of the reversing semi-toroid 13, thence the flowing effluvium enters the neck area 22, of the body 17. It is understood that each succeeding efflux area as between the co-acting semi-toroids is slightly larger than its respective preceding efflux area, whereby the normal back pressure in the exhaust manifold is not increased, and the flow stream of the exhaust is not restricted by the several reversings.

In providing the mixing members above described, commingling of the by-products of combustion is greatly enhanced, and the propagation of flame within the flowing effluvium is prolonged, thus the co-acting semi-toroids as arranged function as an after burner without the inducement of air, whereby any burnable constituents of the effluvium, such as free hydrocarbons and carbon monoxide, are eliminated.

Below the neck 22, above referred to, the body portion 17, is formed to provide an internal diameter considerably larger than the internal diameter of neck 22, and within this enlarged diameter a plurality of heat resistant ceramic sleeves 25, having the form of elongated cylindrical rings, are provided. Each sleeve 25, has imbedded therein a wound, electrically insulated, coil 26; also imbedded within the outlines of said sleeves 25 are a plurality of female electrical connectors 27; these female connectors are spaced advantageously circumferentially, 180° apart.

It will be obvious from FIG. 1 that the internal diameters of sleeves 25, throat 22, and efflux orifice 11, are substantially equal, whereby the flow area throughout the device is constant. Also, there are provided in depending body 17, a plurality of access apertures 28, so displaced therein, 180° apart circumferentially, so that when the ceramic sleeves 25, are assembled within body 17, the transverse axis of the female connectors 27, and apertures 28, are respectively coincidental.

Each of the ceramic sleeves 25 has, suspended within the flow area thereof, a capturing spiral helix 29, conoidial in form, with longitudinal axis lying substantially upon the longitudinal axis of the flow area. Each helix 29, has affixed to its respective terminal ends a male connector 30, which is arranged to interengage the respective female connectors 27, imbedded in their respective ceramic sleeve 25. These capturing helixes 29, are advantageously formed of flat steel wire, having dimensions of approximately thirty thousandth of an inch thick and one-eighth inch in width, and of steel having a high resistance to oxidation at high temperatures, such as chrome-nickel austenitic steel, such as S.A.E. 30310.

In respect to the imbedded coils 26, as shown in FIGS. 1–4, where they are illustrated as trapezoidal in cross-section, and the spiral helixes 29, conoidal in outline, carried by sleeves 25, through the female connectors 27 and male connectors 30, since these members are identical in parts and assembly with respect to said parts, it will not be necessary to explain the function of but one of the assemblies. It will also be seen that the lower sleeve 25, carrying its various parts has been assembled in the device in a reversed position as respects the upper sleeve 25. The purpose for this reversed position will be more fully explained hereinafter with respect to the effluvium flow.

The magnetic coils 26, being wound in such a manner, substantially trapezoidal in cross-section, so that when energized through circuit leads 31, 31*a*, interconnected to female connectors 27, will cause the magnetic field acting upon the effluvium stream, flowing therethrough, to substantially conform to the conoidal outline of the capturing helix 29, since the greater magnetic flux density is about the smaller diameter of the capturing helix 29, the flux density graduating to a lesser density about the larger diameter of the capturing helix 29.

As described heretofore the sleeves 25, carrying related parts are alike in form and assembly, but the lower sleeve assembly, as shown in FIG. 1, is in a reversed position in relation to the other. In thus reversing the lower unit, advantage is taken of the results obtained by the function of the upper unit acting upon the effluvium flow, which has been more compressed adjacent the lower end of the upper sleeve 25, whereupon the stream flow enters the greater magnetic flux density of the lower unit, whereby the effluvium stream flow is caused to assume an hour-glass outline as it passes through the device in close conformity to the area encompassed by the capturing helixes 29, suspended in the path of said stream.

The upper spiral helix 29 is supplied with an appropriate EMF of positive current voltage through the circuit connectors 32 of such potential that the atoms of the by-products of combustion are stripped of their respective negative electrons which are removed and drawn off as current to the ground. The remaining nuclei having thus been ionized, pass through the device, whereupon they encounter the lower magnetic field of the suspended spiral helix 29 upon which an EMF of negative current voltage of sufficient potential is impressed through the circuit connectors 33 whereby the positive ionized nuclei are captured and collected by the negative current in the spiral helix 29 and drawn off or conducted as current to ground. The potential of the current supplied to the helix 29 will in each case be determined by the particular composition of the combustion by-products and by the volume and flow characteristics of the by-products to be treated. An appropriate EMF of positive current voltage having a minimum potential of 100,000 electron volts which is impressed through the circuit connectors 32 is in general satisfactory. Increasing or decreasing the EMF in known manner to reduce the objectionable by-products of combustion to the desired level may be readily carried out and adjusted to the particular effluvium at hand.

FIG. 5 illustrates one conventional circuit arrangement that may be used for generating the magnetic field in the apparatus of FIG. 1. FIG. 6 illustrates a partial circuit arrangement which may be substituted in the dot and dash box of FIG. 5 whereby higher voltages may be accommodated in the circuit of FIG. 5. A preferred form of circuit is shown in FIG. 7 and, since the same numerals in FIGS. 5, 6 and 7 refer to identical parts, it is not deemed necessary to describe the circuits of FIGS. 5 and 6 in detail.

Figure 7:
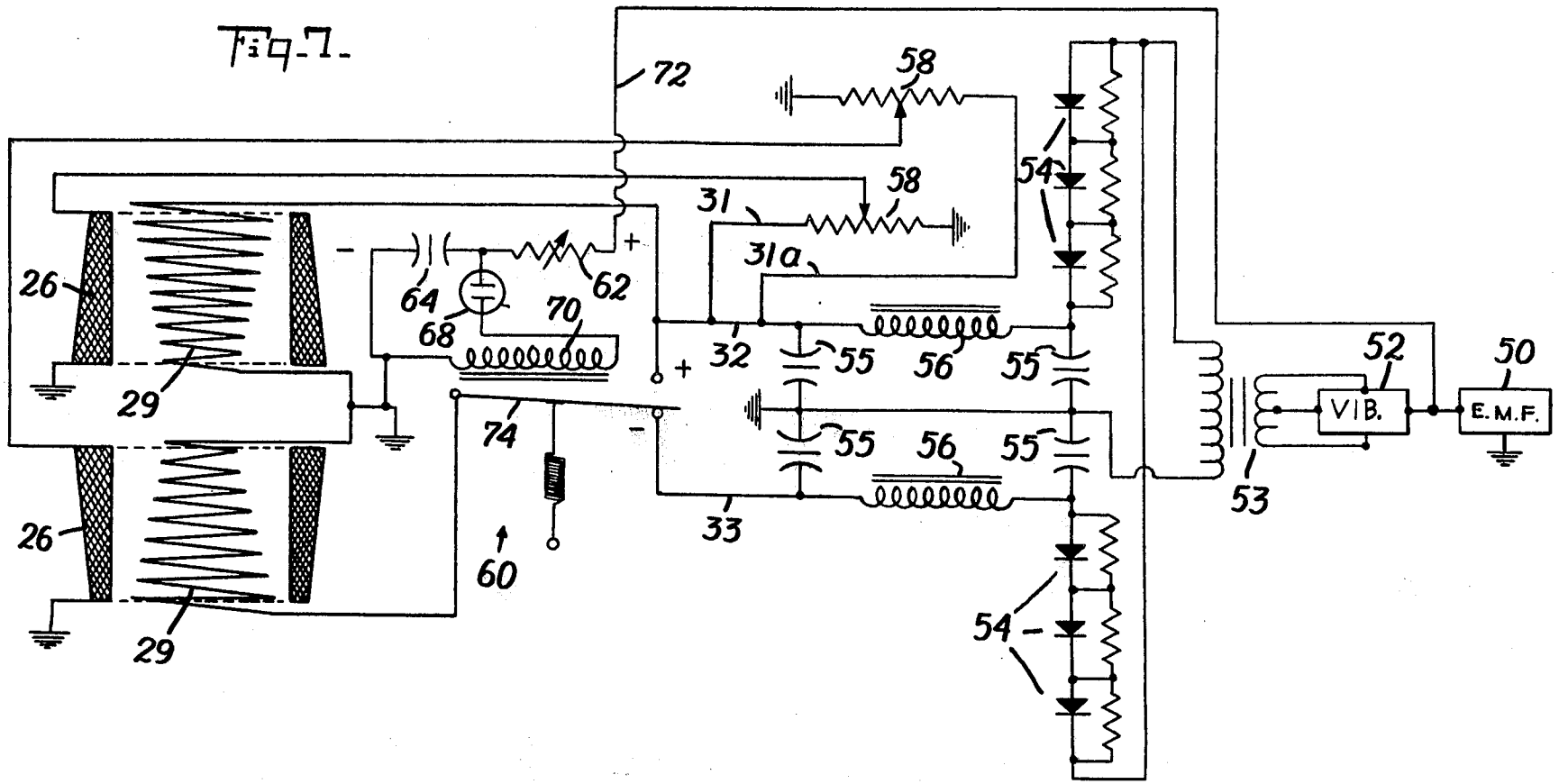
FIG. 7 is a schematic circuit arrangement of a preferred embodiment in which a cyclic time gate is incorporated therein, the purpose of which will be fully described hereinafter with respect to the device and as pointed out in the claims.

Referring to FIG. 7, there is provided a circuit comprising an EMF 50, of direct current connected to a means for alternating said current, such as a vibrator 52, which is connected to a transformer 53, the leads from which, as shown, are interconnected in known manner, with a plurality of diodes 54, capacitors 55 and choke coils 56, as will provide a substantially straight line high voltage of positive and negative current on the leads 32, 33, respectively. The positive lead 32 is connected to the upper capturing helix 29, and the negative lead 33 is connected intermittently, to the lower capturing helix 29, the purpose of which will be more fully described hereinafter.

Also connected to positive lead 32, are leads 31, 31*a*, connected to upper coil 26 and lower coil 26, respectively, and each of said leads 31, 31*a*, is provided with a variable resistance 58 for control, when energized, of the magnetic flux density of said coils.

There is also optionally provided in the circuit a transducer 60 or time gate, cyclical in function, and comprised of a variable resistance 62, a capacitor 64, a neon tube 68, and a relay coil 70, which when energized through lead 72, connected to the direct current source, actuates a spring loaded swing switch 74, from the negative pole of lead 33, to the positive pole of lead 32. In thus providing the variable resistance 62, for the loading of the capacitor 64, any chosen time cycle desired may be achieved; whereupon when the capacitor 64 reaches its highest potential, current flows into the neon tube 68, ionizing the gas therein, which allows current to flow into the relay coil 70, which is energized by the dumping of the potential stored in capacitor 64, thus acting as an electro-magnet, to attract the spring loaded swing switch 74, to the positive pole of lead 32. Following the dumping of said potential of capacitor 64, the neon tube 68 becomes deionized, whereupon the relay coil 70 is de-energized and the spring loaded swing switch 74 returns to the negative pole of the lead 33.

From the above description of the replicating action of the time gate, it will be obvious that any particulates captured by the normally negative lower helix will be rejected therefrom and scavenged by the velocity of the flow stream, thereby inhibiting the insulation of the lower helix by the accumulation of any captured particulates.

The device is also provided with a plurality of gaskets 80 appropriately affixed at surfaces of juncture and compression as illustrated in FIG. 1, thus prohibiting the infusion of ambient atmosphere into the effluvium passage. Also affixed to the depending body portion 17, as by clamping ring 82, and bolts 84, is the header pipe 86, of a muffler exhaust system, not shown.

As many possible embodiments may be made of the above invention and as the art herein described might be varied in various parts, all without departing from the scope of the invention, it is to be understood that all matter hereinbefore set forth, or shown in the accompanying drawings, is to be interpreted as illustrative and not in a limiting sense.

What is claimed is:

1. The method of treating and removing combustion by-products in an effluvium from an internal combustion engine in a housing having means for generating at least one magnetic field within said housing and a first member for removing one or more negative electrons from atoms of said combustion by-products positioned within the housing in said at least one magnetic field and a second member positioned within said magnetic field downstream from said first member for collecting ionized nuclei resulting from the said removal of electrons from said atoms which comprises the steps of:

a. supplying electric current to said means to generate one magnetic field within said housing, b. passing combustion by-products of said effluvium through said housing, c. supplying positive current voltage to said first member to give it a positive charge to thereby remove one or more negative electrons from said atoms of said combustion by-products, d. supplying negative current voltage to said second member located downstream of said first member to give it a negative charge to thereby collect ionized nuclei resulting from said removal of electrons from said atoms by said first member, and e. the said magnetic field directing the charged particles toward the said first and second members.

2. The method specified in claim 1 which includes the step of mixing the combustion by-products in the effluvium to enhance the commingling thereof prior to passing the effluvium through said magnetic field.

3. The method specified in claim 1 which includes the step of generating a second magnetic field within said housing in the area of said second collecting member downstream from said first member for removing additional ionized nuclei from suspension in the effluvium.

4. Apparatus for treating the atoms in combustion by-products in an effluvium from an internal combustion engine which comprises a housing, passage means within said housing for passage of effluvium from inlet to outlet thereof, first means for generating a magnetic field in said housing, a first capturing means within the area of said magnetic field within the housing adapted to receive positive current voltage and thereby strip one or more negative electrons from said atoms of the combustion by-products to produce ionized nuclei, a second capturing means for collecting said ionized nuclei from said effluvium within said magnetic field, means for supplying positive and negative voltage current to said first and second capturing means respectively, and said first means for generating a magnetic field being effective to direct the charged particles toward the said first and second capturing means.

5. Apparatus specified in claim 4 in which mixing members are provided upstream from said first means for generating a magnetic field to enhance the commingling of the combustion by-products.

6. Apparatus specified in claim 4 which include means for collecting and removing said ionized nuclei comprise a capturing member downstream from said first means, said capturing member having a negative current voltage flowing therethrough which collects the ionized nuclei and conducts them as current to ground and a member adapted to generate a magnetic field in the area occupied by said capturing member.

7. Apparatus specified in claim 6 in which means are provided for intermittently changing the polarity of said negative current flowing through said capturing member.

* * * * *